US009028295B2

(12) United States Patent
Bradnam et al.

(10) Patent No.: US 9,028,295 B2
(45) Date of Patent: May 12, 2015

(54) REEL MOWER GRINDER WITH AUTO-INDEX MECHANISM

(75) Inventors: Paul Bradnam, Suffolk (GB); Gary Bonfield, Suffolk (GB)

(73) Assignee: Bernhard and Company, Ltd., Warwickshire (GB)

( * ) Notice: Subject to any disclaimer, the term of this patent is extended or adjusted under 35 U.S.C. 154(b) by 95 days.

(21) Appl. No.: 13/984,026

(22) PCT Filed: Feb. 9, 2012

(86) PCT No.: PCT/GB2012/050292

§ 371 (c)(1),
(2), (4) Date: Aug. 6, 2013

(87) PCT Pub. No.: WO2012/107772

PCT Pub. Date: Aug. 16, 2012

(65) Prior Publication Data

US 2013/0316619 A1 Nov. 28, 2013

Related U.S. Application Data

(60) Provisional application No. 61/440,996, filed on Feb. 9, 2011.

(51) Int. Cl.

| | |
|---|---|
| ***B24B 49/00*** | (2012.01) |
| ***B24B 3/42*** | (2006.01) |
| ***B24B 3/36*** | (2006.01) |

(52) U.S. Cl.

CPC .. *B24B 3/42* (2013.01); *B24B 3/363* (2013.01)

(58) Field of Classification Search

USPC ..... 451/11, 45, 141, 421

See application file for complete search history.

(56) References Cited

U.S. PATENT DOCUMENTS

| | | | | |
|---|---|---|---|---|
| 4,148,158 | A * | 4/1979 | Hewitt | 451/141 |
| 4,621,456 | A * | 11/1986 | Winstanley | 451/141 |
| 7,503,835 | B2 * | 3/2009 | Cotton | 451/45 |

* cited by examiner

*Primary Examiner* — Lee D Wilson
*Assistant Examiner* — Shantese McDonald
(74) *Attorney, Agent, or Firm* — Minh N. Nguyen; Next IP Law Group LLP

(57) ABSTRACT

A grinder for sharpening the blades of reel mowers automatically to grind the underside of the blade of the reel mower.

7 Claims, 3 Drawing Sheets

REEL MOWER GRINDER WITH AUTO-INDEX MECHANISM

CROSS REFERENCE TO RELATED APPLICATIONS

This application is a section 371 national-stage phase of International Application No. PCT/GB2012/050292, filed 9 Feb. 2012, titled "REEL MOWER GRINDER WITH AUTO-INDEX MECHANISM" which claims priority to U.S. Application Ser. No. 61/440,996, filed 9 Feb. 2011, titled "REEL MOWER GRINDER WITH AUTO-INDEX MECHANISM" which is hereby incorporated by reference in its entirety.

TECHNICAL FIELD

This invention is for a grinder to grind the blades of reel type mowers automatically. This grinder also will automatically grind the backside of the blade. In other words, this grinder will perform both spin and single blade relief grinding operations. The relief grinder mechanism has an auto mechanism to allow automated indexing from grinding the relief side of one blade to the relief side of another blade.

Relief Grinding (Blade Thinning)

Relief grinding, sometimes referred to as blade thinning, is the process by which material is removed from the reverse side of a mower cylinder blade to provide a clearance angle and reduce the potential contact area between cylinder and bottom blade (reel and bed knife).

Manufacturers of cylinder mowers provide this on almost all of their mower cylinders with two purposes: a) to provide a clearance behind the cutting edge to allow the debris (clippings) to drop immediately after cutting of the grass leaf, b) to reduce the contact area and reduce loadings on the mower drive and transmission where cut is achieved with mowers set with cylinder to bottom blade contact. (This contact can range from a light "kiss" or "whisper" on rotation to so tight that manual rotation of the cylinder is impossible)

Particularly in consideration of b) above, it is desirable to minimise the load on power plant and transmission of mowers to achieve restoration of "factory specifications" before customers are willing to consider cut or performance issues.

For many years Bernhard and Company has been able to demonstrate that by appropriate mower set up, no contact between cylinder and bottom blade, can both provide a superior quality of cut to the grass leaf and eliminate the need for a (secondary) relief grind to the blades. This is only possible where the maintenance facility looking after mowers has the time, equipment and ability (and willingness to accept and control the approach) to follow an appropriate grinding regime to maintain this quality of mower set up and cut. Not every facility can meet the criteria so that alternative methods of sharpening and mower set up make relief grinding essential.

It can be seen that the relief grinding operation is a single blade grinding operation that typically requires maintaining the cylinder blade position relative to the grindstone that is to remove material and achieve a specific angle on the back of each blade. Such position retention is usually achieved by rotating a blade against a support. It is also necessary to accurately move from one blade to the next in order to complete the process for the complete cylinder.

Both rotational positioning against a support and the "index" from blade to blade may be achieved manually but this introduces a requirement for operator skill and confidence whilst simultaneously being tricky to establish safely.

(Historically an operator might place their hand into the cylinder, between blades, in order to affect the control required)

DETAILED DESCRIPTION OF THE DRAWINGS

Figure 1:
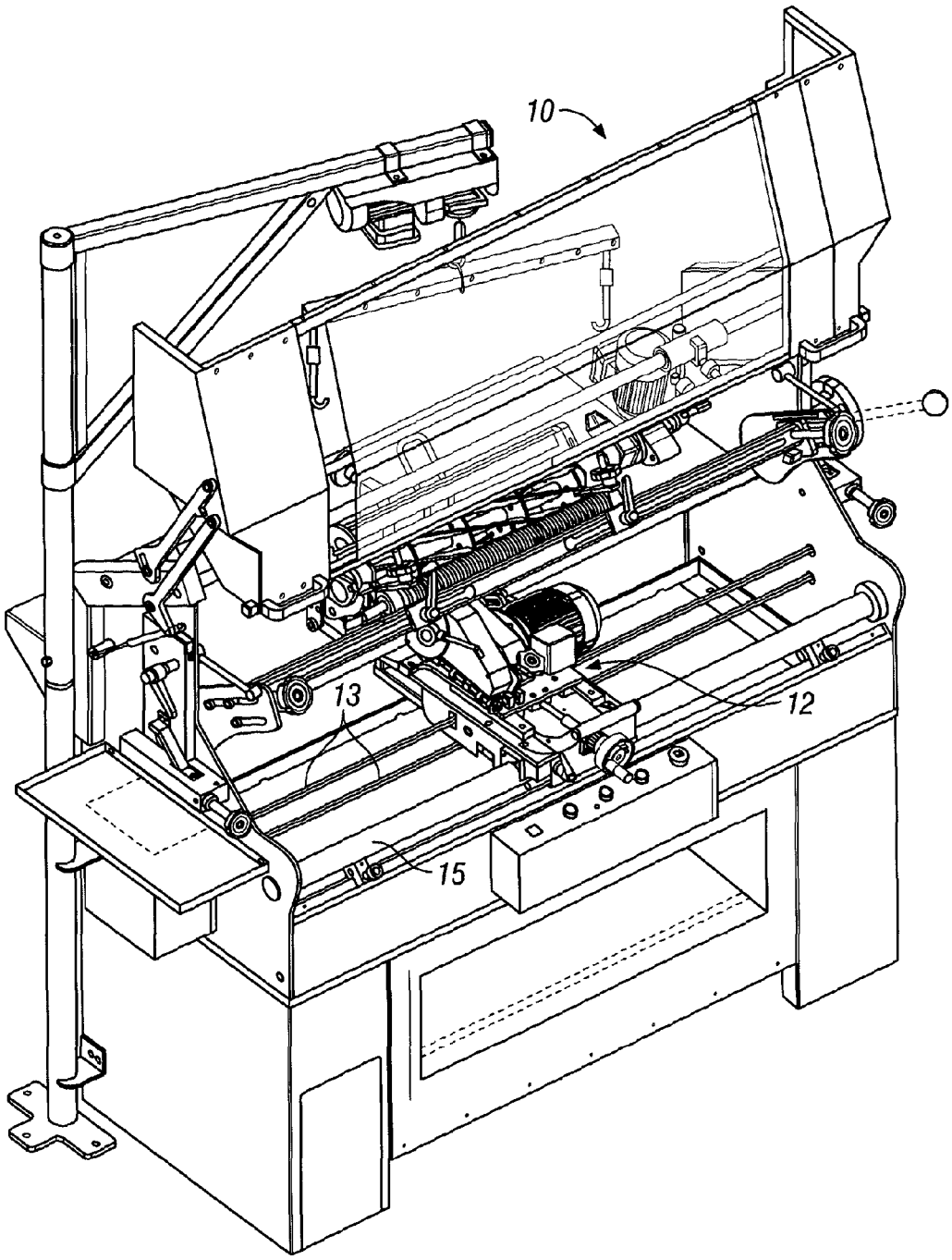
FIG. 1 is a perspective view of a grinder for grinding the blades of a reel type mower with the auto-indexing mechanism installed for grinding the back side of each blade.
Figure 2:
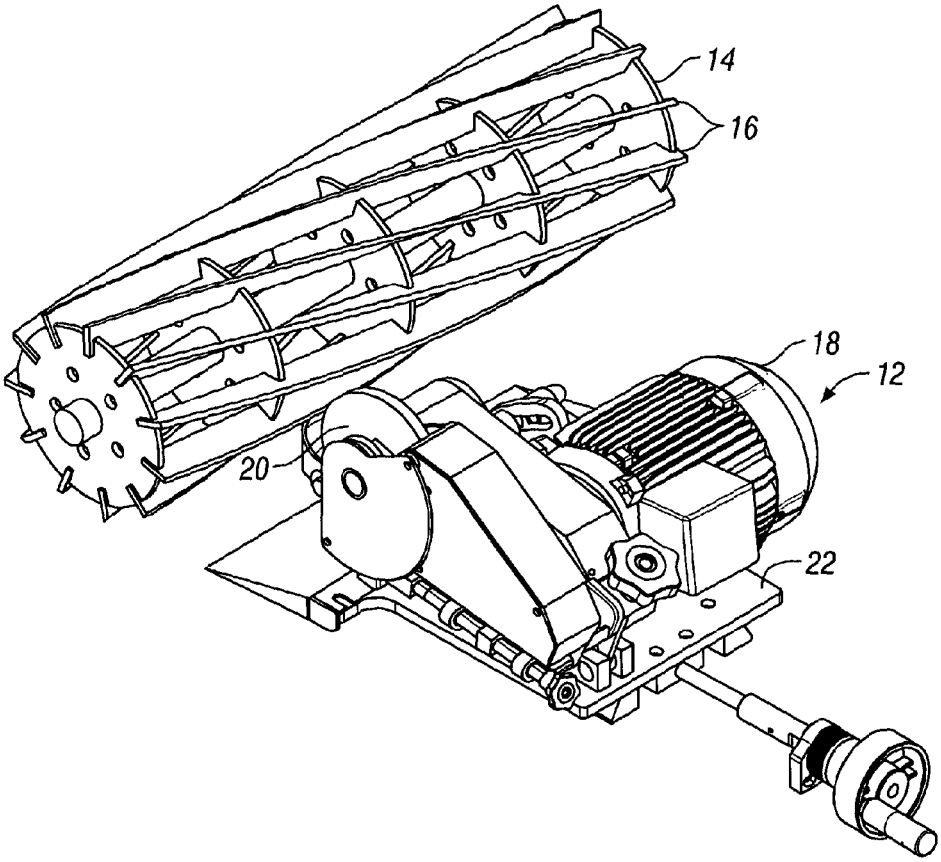
FIG. 2 is perspective view of the cylinder with blades from a mower along with the grinder and auto-indexing mechanism.
Figure 3:
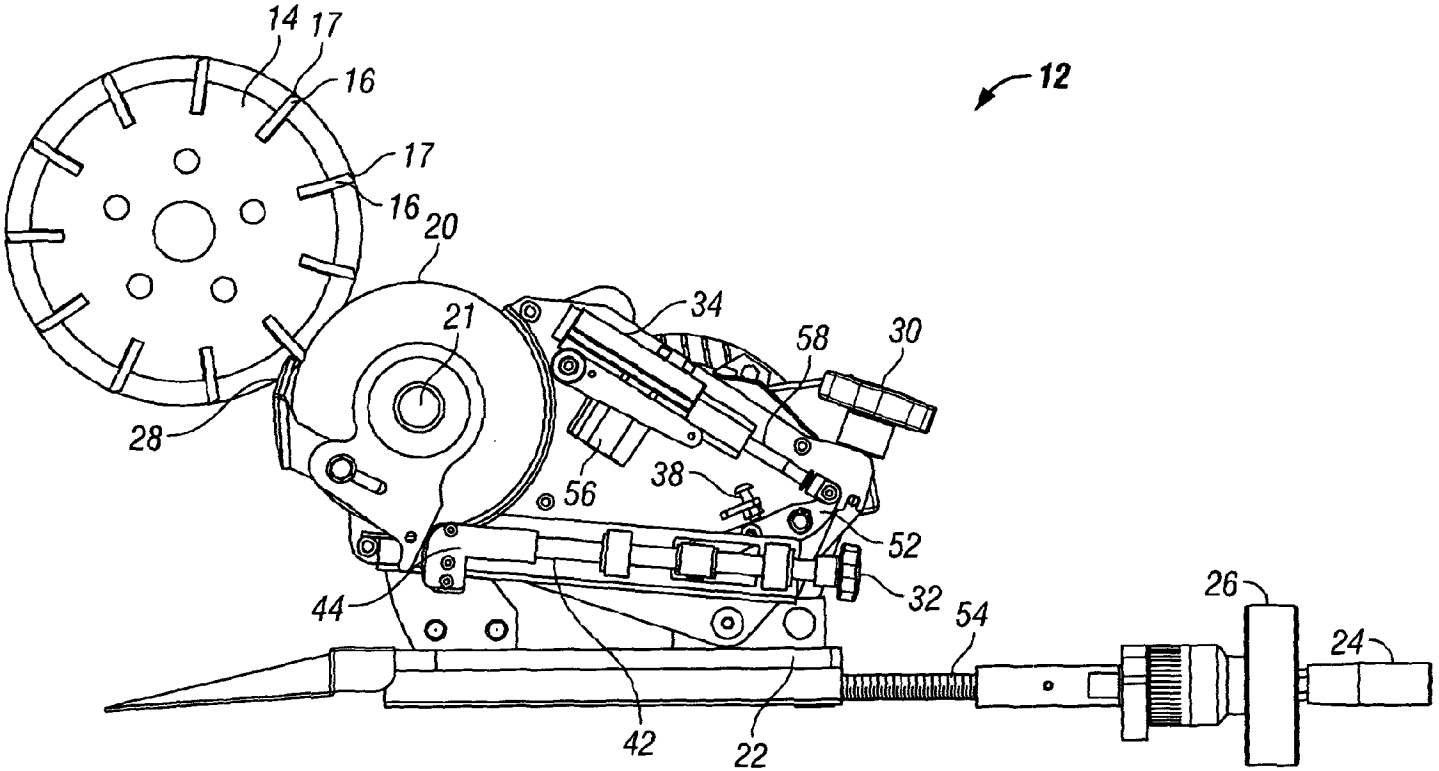
FIG. 3 is a side view of the grinder with the auto-indexing mechanism, the reel of the mower in which the back side of the blades are set to be sharpened.

For the purposes of understanding this invention, the following parts list is provided:

PARTS LIST

10. Grinding Machine
12. Grinding head complete with auto-indexing mechanism
13 Chain (reciprocating) for moving auto-indexing mechanism
14. Cylinder with cutting blades for reel mower
15. Rods (rails) to guide & support of the grinding head complete with auto-indexing mechanism
16. Blades on reel mower
17. Relief angle of blade
18. Electric motor for turning grinding stone
20. Grindstone
21. Axis of grindstone
22. Platform (motor plate) for auto-indexing mechanism
24. & 26. Handwheel for controlling mechanism to regulate distance of grinding head complete with auto-indexing mechanism from cutting cylinder.
28. Rest for holding blade of mower in position for grinding.
30. Control knob for adjusting height of grindstone
32. Adjustment knob to control position of rest and thereby blades of cylinder of reel mower relative to grindstone
34. Electric actuator
38. Adjustable stop
42. Plunger rod
44. Plunger-adjuster push block
52. Pivotal arms
54. Threaded shaft (feed screw)
56. Electric motor
58. Shaft This invention is a new spin and relief grinding machine, called the Dual Master 3000iR, manufactured by Bernhard & Co. The grinding head complete with auto-indexing mechanism 12 is moved into proper position in relation to the cylinder 14 to be ground by the operator using mechanism 26 for controlling this distance of grinding head complete with auto-indexing mechanism from the cutting cylinder by moving platform 22 either closer or away from the cylinder. Handwheel 26 can be used to fine tune this distance. This mechanism has a threaded shaft 54 to fine tune this distance.

RELIEF GRINDING

Mower cylinder 14 is rotated such that the blade 16 to be ground is held against the rest 28. This is held there by a motor connected to the axial spindle of the reel 14 via a torque controlling element (such as a slip clutch) that allows constant downward pressure so as to maintain constant position of reel blade 16 relative to grindstone 20 position via contact between the cylinder blade (16) being ground and the rest 28. Mower cylinder 14 is rotated such that the blade 16 to be ground) is held against the rest 28.

An electro-mechanical mechanism incorporated into grinding head 12 is employed that allows automatic indexing between cylinder blades 16 after a double pass of each blade. A safety switch (not shown) has been added to the index mechanism to eliminate the potential of the premature restart of lateral traverse before the index process is complete.

The following invention is a single grinding machine that can perform both 'spin' and single blade grinding functions (and a machine that also can, through minor reconfiguration, also perform the grinding of mower bottom blades).

This invention uses a single rest 28. In this invention, the cylinder blade 16 remains in contact with the rest 28 at both ends of the traverse. The rest 28 is wide enough to allow the cylinder to rotate without the end of the blade 16 contacting the grindstone 20. The support surface of the rest 28 is radially positioned relative to the grindstone axis 21 by an electric actuator 34 and the pivotal arms 52. The cylinder 14 is rotated so that the underside of the blade to be ground abuts and remains in contact with this rest 28 during the grinding to hold the blade in the precise position for grinding. The Figures illustrate a position during traverse of the reel of the mower from right to left and back to right before moving to the next blade. The relief grinding starts by the electric motor 56 being activated to push shaft 58 forward towards the cylinder 14. The pivotal arms 52 with their leverage move to an over-centre position against adjustable stop 38 to hold the plunger 42 forward placing the rest 28 in location for grinding. The grinding head complete with auto-indexing mechanism 12 is moved by chain 13 from right to left on the grinding machine 10. When the grinding wheel approaches the left side of the grinding machine 10, a switch senses the limit of travel to the left and the chain 13 reverses direction and moves the grinding head complete with auto-indexing mechanism 12 to the right. The sensing mechanism on the left is set so the grinding continues until it grinds to the end of the blade 16 so the relief angle 17 of the blade is the same to the end of the blade. A dwell in the traverse of the blade to the left ensures that the relief cut is uniform to the end of the blade.

After reversing direction, the auto-indexing mechanism traverses to the right side of the grinding machine 10 grinding the relief angle 17 in the blade 16. The grinding is done in two sweeps across the blade 16 to ensure uniformity of relief angle 17. A sensor (not shown) on the right side of the grinding machine 10 stops the traverse to the right but allows the grindstone 20 to move to the right to be clear of the blade 16. At the right hand limit of traverse, the blade end clears the grindstone so that cylinder can rotate. The blade remains in contact with the support rest. Cylinder rotation may pause to take the load off the rest 28. The electric actuator 34 receives a message from the sensor on the right and a plc (not shown) to pull the plunging rod 42 away from the cylinder 14. This allows gravity assisted by the torque on the cylinder to rotate the cylinder to advance the next blade 16 towards the grinding position. At this point, the pivotal arms 52 and actuator 34 move the rest 28 into the grinding position where it catches the next blade and stops the rotation of the cylinder 14. Rotation of the cylinder 14 creates downward pressure on rest 28 which in turn operates a safety switch (not shown) that triggers traverse to the left and allows the grindstone 20 to grind from right to left as the auto-indexing mechanism 12 traverses from right to left. A dwell (pause) in traverse at reverse position allows grindstone 20 to ensure that relief angle 17 is applied right to the blade end before traverse commences left to right. After reversing direction, the auto-indexing mechanism traverses to the right side of the grinding machine 10 grinding the relief angle 17 in the blade 16. The grinding is done in two sweeps across the blade 16 to ensure uniformity of relief angle 17. A sensor (not shown) on the right side of the grinding machine 10 stops the traverse to the right but allows the grindstone 20 to move to the right to be clear of the blade 16. At the right hand limit of traverse, the blade end clears the grindstone so that cylinder can rotate. The blade remains in contact with the support rest.

This process is repeated until all of the blades have relief ground.

SPIN GRINDING

The grinding head with the auto-indexing mechanism 12 is also capable of spin grinding. The conversion is very simple for an operator to accomplish. The grind wheel 20 needs to be changed to a grind wheel more suitable for spin grinding. The rest 28 for holding the blade in position for relief grinding is removed or disengaged. The grind stone 20 is positioned to grind the front side of the blade 16 while the reel or cylinder 14 is spinning. The grind stone 20 traverses from right to left while grinding.

Installation of Auto index Mechanism

This auto-index mechanism can be installed on many different spin grinding machines with simple changes in parts for installing. The auto-index mechanism controls are basically self contained in the mechanism as explained above. The mechanism can be constructed to do both relief grinding and spin grinding or only constructed to do relief grinding alone. This mechanism can be designed and incorporated in a new machine.

We claim:

1. A grinder apparatus for grinding the backside of the blades on a reel mower for cutting grass, the grinding apparatus comprising:

means for applying controlled torque to the reel mower and its cutting blades;

a rotatable grind-stone;

means for rotating the grind-stone;

a carriage for supporting the grindstone and moving the grind-stone from right to left or vice versa along the blade on the mower to allow the grindstone to sharpen the back side of each blade;

a rest for holding a blade of the mower in a position against the grind stone for grinding the back side of the blade;

means for releasing the grindstone from the blade allowing the reel to rotate to the next blade, which in turn a relief grind is ground into the back side of the next blade, and sequentially ground into all of the other blades on the apparatus;

means for limiting the traverse of each of the blades during the relief grinding operation on both the right and left ends of each blade on the reel;

sensing means to determine how far the right and left ends of the reel are on the right and left ends of the carriage;

means to transmit the information to means for stopping the traversing of the reel beyond those set limits on both the right and left side of each blade so as to calculate the stop of the traversing and grinding of each blade that exceed any of those limits; and, an electric actuator connected to a plunger in contact with the rest, the electric actuator being configured to pull the plunger away from the reel to allow the reel to rotate to advance the next blade towards the grinding position, and the electric actuator being in contact with the sensing means to insure the grinding of the relief angle in the blade to each end of the blade.

2. The grinder apparatus of claim 1, in which the electric actuator is held in contact with the rest at least in part by the leverage of pivotal arms.

3. The grinder apparatus of claim 1, in which the relief grinding is done by two sweeps of the grind-stone across the blade, i.e. right to left and back or vice versa.

4. The grinder apparatus of claim 3, wherein the electric actuator is arranged to receive a message from the sensor on the right side of the grinder apparatus and a plc to pull the plunger away from the cylinder.

5. The grinder apparatus of claim 1, in which the sensing means comprises sensor on the right side of the grinder apparatus which stops the traverse to the right but allows the grind-stone to move to the right to clear the blade, which in turn allows the reel to rotate until the next blade is in position to be relief ground.

6. A grinder apparatus for grinding the backside of the blades on a reel mower for cutting grass comprising:

a platform for attaching to a grinding machine with a mechanism for controlling and adjusting the position of the grinder apparatus in the grinder machine in relation to the reel;

a rotatable grindstone;

means for rotating the grindstone;

the platform supporting the grindstone and moving the grindstone from right to left or vice versa along the blade on the mower to allow the grindstone to sharpen the back side of each blade;

a rest for holding a blade of the mower in a position against the grind stone for grinding the back side of the blade;

means for releasing the grindstone from the blade allowing the reel to rotate to the next blade, which in turn a relief grind is ground into the back side of the next blade, and sequentially ground into all of the other blades on the apparatus;

means for limiting the traverse of each of the blades during the relief grinding operation on both the right and left ends of each blade on the reel;

sensing means to determine how far the right and left ends of the reel are on the right and left ends of the carriage;

means to transmit the information to means for stopping the traversing of the reel beyond those set limits on both the right and left side of each blade so as to calculate the stop of the traversing and grinding of each blade that exceed any of those limits; and, an electric actuator connected to a plunger in contact with the rest, the electric actuator being configured to pull the plunger away from the reel to allow the reel to rotate to advance the next blade towards the grinding position, and the electric actuator being in contact with the sensing means to insure the grinding of the relief angle in the blade to each end of the blade.

7. The grinder apparatus of claim 6, in which the electric actuator is held in contact with the rest at least in part by the leverage of pivotal arms.

* * * * *